United States Patent [19]

Ogami

[11] Patent Number: 4,955,343

[45] Date of Patent: Sep. 11, 1990

[54] CYLINDER BLOCK

[75] Inventor: Etsuo Ogami, Yokohama, Japan

[73] Assignee: Nissan Motor Co., Ltd., Yokohama, Japan

[21] Appl. No.: 450,699

[22] Filed: Dec. 14, 1989

[30] Foreign Application Priority Data

Dec. 24, 1988 [JP] Japan ..... 63-167146[U]

[51] Int. Cl.[5] ..... F02F 7/00

[52] U.S. Cl. ..... 123/195 R; 123/195 E; 123/198 R; 123/179 R

[58] Field of Search ..... 123/179 R, 179 M, 195 R, 123/195 E, 198 R; 74/6

[56] References Cited

U.S. PATENT DOCUMENTS

| | | | |
|---|---|---|---|
| 3,022,778 | 2/1962 | Stemen | 123/195 E |
| 3,384,063 | 5/1968 | Moulton et al. | 123/195 R |
| 3,598,093 | 8/1971 | Tanaka | 123/179 M |
| 4,362,065 | 12/1982 | Baratti | 123/179 M |
| 4,507,566 | 3/1985 | Leatherman et al. | 123/179 M |
| 4,849,665 | 7/1989 | Kitamura et al. | 123/195 E |

FOREIGN PATENT DOCUMENTS 61-53568 4/1986 Japan .

*Primary Examiner*—Willis R. Wolfe
*Assistant Examiner*—Weilun Lo
*Attorney, Agent, or Firm*—Pennie & Edmonds

[57] ABSTRACT

An internal combustion engine includes a cylinder block, and a plurality of main bearing caps secured to the cylinder block at a predetermined portion. A flange integral with the cylinder block has first and second end walls extending from the cylinder block and spaced from each other, and a peripheral wall which interconnects the first and second end walls. The first, second and peripheral walls cooperate with the predetermined portion of the cylinder block to define a chamber. The peripheral wall is formed with an opening communicating with the chamber. The opening and the chamber serve as an access to the predetermined portion. The opening is closed by a plug.

9 Claims, 8 Drawing Sheets

CYLINDER BLOCK

BACKGROUND OF THE INVENTION

The present invention relates generally to a cylinder block for an internal combustion engine and, particularly to a structure of a site for a starter motor.

Upon starting, a crankshaft of an automotive engine is turned by a starter motor up to a required engine speed. The starter motor can not be installed freely to the cylinder block, that is, its mounting position must be selected under certain restrictions. Additionally, owing to an improvement in the engine performance and requirements of an increased occupant room space, an engine room space and the starter motor mounting space are both limited. Under such conditions, the starter motor is mounted to the engine at a starter motor mounting flange which is formed at a rear portion of the cylinder block (refer to Japanese Utility Model Publication No. 61-53568).

In the past, the starter motor has been mounted to the cylinder block with side bolts at a starter motor mounting flange which was formed in correspondence to the rearmost one of main bearing caps. With such structure, however, since the flange was obstructive to tightening operation of a side bolt for the rearmost main bearing cap, this side bolt was omitted, or the flange was formed on the cylinder block to rear of a mounting portion of this side bolt. Thus, problems are encountered such that there is insufficient rigidity for mounting of the starter motor and a transmission, and for supporting of a crankshaft due to the absence of the side bolt for the rearmost main bearing cap.

An object of the present invention is to provide a structure of a mounting site for a starter motor, which mounting site is of the adequate rigidity and allows a bolt for a main bearing cap easy to mount and remove.

SUMMARY OF THE INVENTION

There is provided, according to the present invention, in an internal combustion engine:

a cylinder block having a predetermined end surface;

a plurality of main bearing caps including a predetermined main bearing cap, said plurality of main bearing caps being secured to said cylinder block at a plurality of portions including a predetermined portion, said predetermined main bearing cap being secured to said cylinder block at said predetermined portion;

a flange integral with said cylinder block, said flange having first and second end walls extending from said cylinder block and spaced from each other, and a peripheral wall which interconnects said first and second end walls, said first, second and peripheral walls cooperating with said predetermined portion of said cylinder block to define a chamber, said first end wall being disposed adjacent said predetermined end surface of said cylinder block, said second end wall being disposed less adjacent said predetermined end surface of said cylinder block, said peripheral wall being formed with an opening communicating with said chamber, said opening and said chamber serving as an access to said predetermined portion;

means for closing said opening;

a starter motor mounted on said flange.

DETAILED DESCRIPTION OF THE INVENTION

Referring now to FIGS. 1 to 4, there is described a first preferred embodiment of the present invention.

Figure 1:
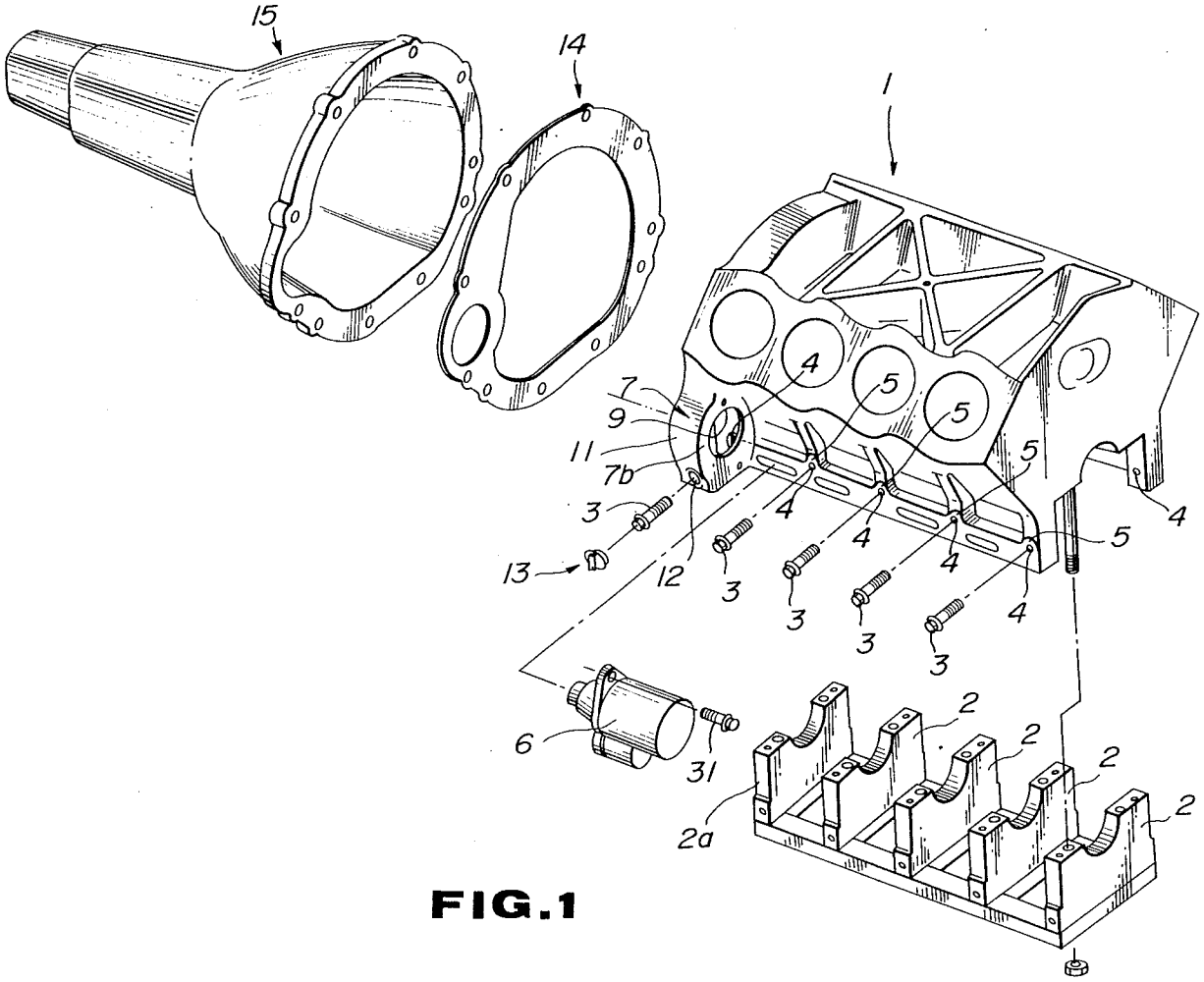
FIG. 1 is an exploded view, with some main components removed, illustrating a first preferred embodiment of a cylinder block according to the present invention.

First, the structure will be described with reference to FIG. 1.

Figure 4:
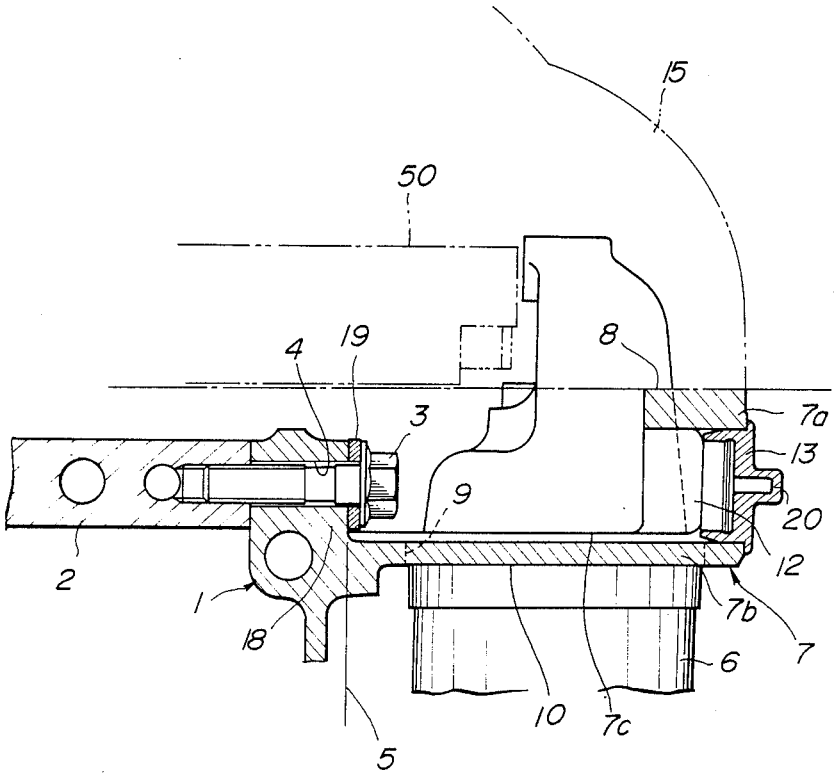
FIG. 4 is a sectional view taken along the line A—A in FIG. 3.
Figure 5:
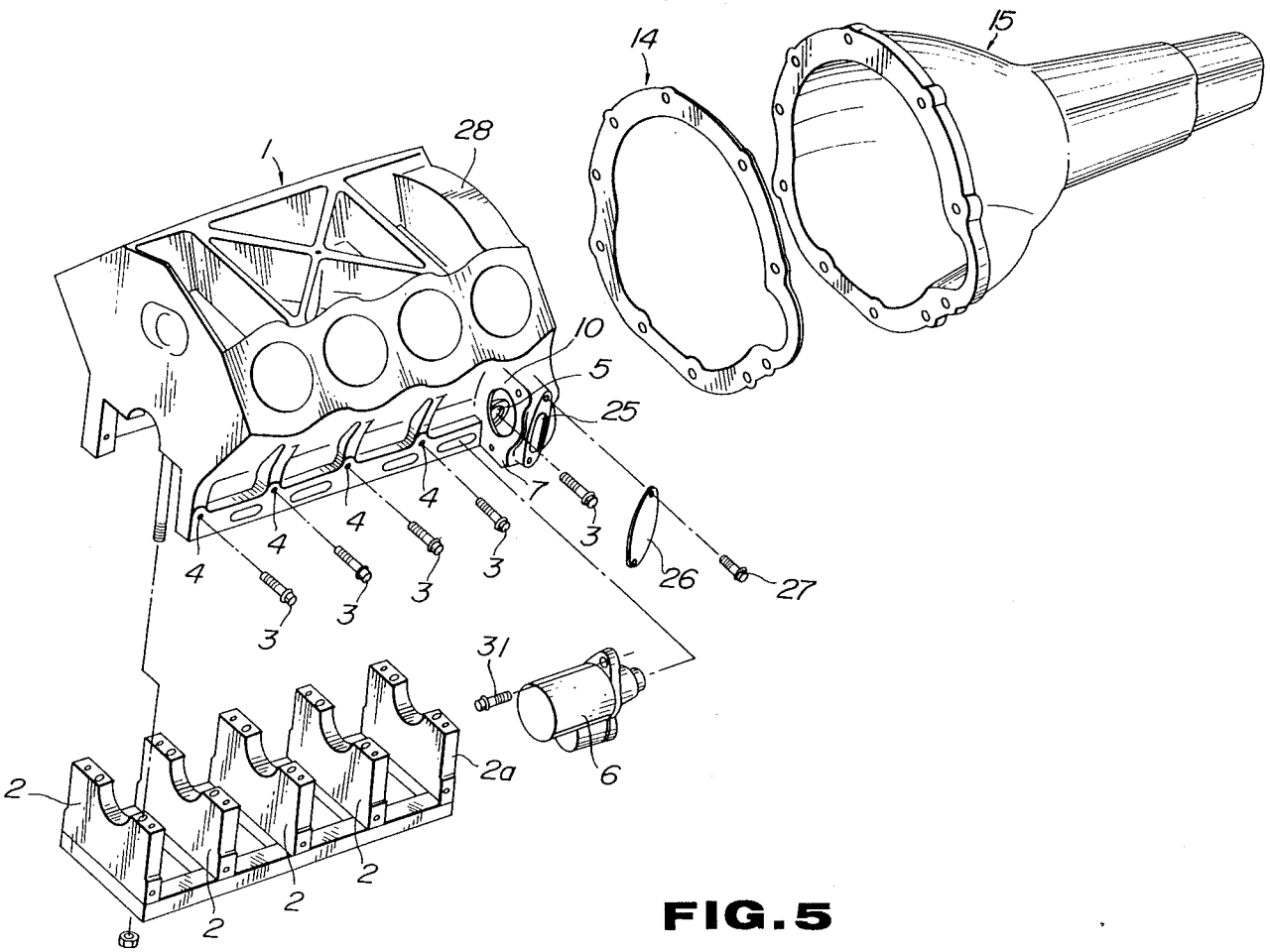
FIG. 5 is a view similar to FIG. 1, illustrating a second preferred embodiment of the present invention.

A cylinder block 1 is formed with four bolt mounting eyes 5 arranged on each of lateral sides in the longitudinal direction thereof. Each of the bolt mounting eyes 5 is formed with a hole 4 for receiving one of side bolts 3 which are used to secure main bearing caps 2 to the cylinder block 1. To mount a starter motor 6 to the cylinder block 1, a flange 7 is formed on and laterally extending from the rear longitudinal end portion of the cylinder block 1 at a portion where one of the side bolts 3 secures the rearmost main bearing cap 2*a* to the cylinder block 1. The flange 7 has two mutually spaced laterally extending end walls 7*a* and 7*b* (see FIG. 4), and a peripheral wall 11 (see FIG. 1) which interconnects the end walls 7*a* and 7*b*. These walls 7*a*, 7*b* and 11 cooperate with the cylinder block 1 to define a chamber 7*c*. As best seen in FIG. 4, the rear end wall 7*a* has a flat outer surface 8 in the same plane as the rear end surface of the cylinder block 1, thus serving as a partition wall for a flywheel 50. As best seen in FIG. 4, the front end wall 7*b* has an outer surface serving as a starter motor mounting surface 10. The peripheral wall 11 is formed with an opening 12 for allowing passage of the side bolt 3 for the rearmost main bearing cap 2*a* and insertion of a tool for tightening the bolt 3. A plug 13 closes the opening 12 for preventing entry of foreign objects. A transmission casing 15 is securely connected to the cylinder block 1 with a rear plate 14 interposed therebetween such that the rear wall 8 of the flange 7 is fixedly connected to the transmission 15. Owing to this connection, the rigidity of the flange 7 is increased.

Figure 2C:
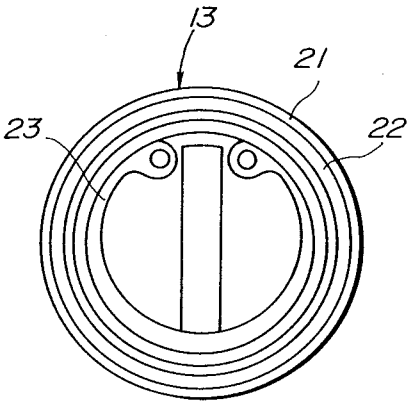
FIG. 2*c* is a bottom plan view of the closure shown in FIG. 2*a,*
Figure 2B:
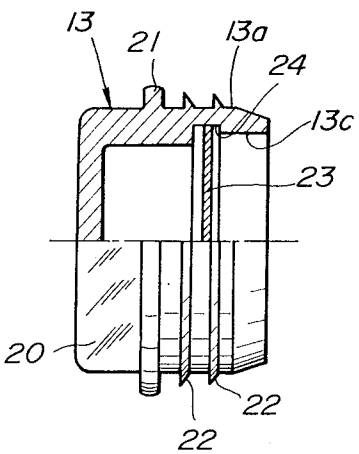
FIG. 2*b* is a side elevation of the closure with an upper half portion sectioned along the line I—I in FIG. 2*a;*
Figure 2A:
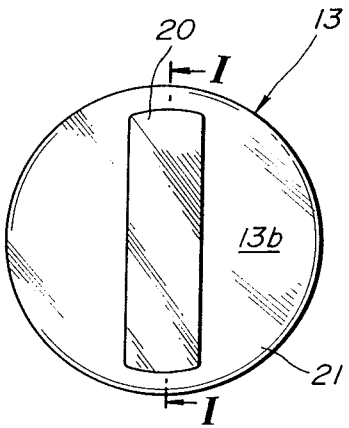
FIG. 2*a* is a top plan view of a closure for concealing a side bolt.

Referring to FIGS. 2*a*; 2*b* and 2*c*, the plug is made of elastic material such as an elastomer, and includes a cylindrical body 13 with a closed end wall 13*b*, a lug 20 on the closed end, and a stopper flange 21 and two lips 22 on the cylindrical peripheral wall of the cylindrical body 13*a*. The plug 13 also includes a C-shaped snap ring 23. The snap ring 23 is inserted in a groove 24 formed in the wall of a bore 13c. The snap ring 23 is disposed between the two lips 22 so that when the plug 13 is inserted into the opening 12 (see FIG. 1), the snap ring 23 is compressed to bias the lips 22 into firm engagement with the adjacent wall of the flange 7, thus assuring secure engagement of the plug 13 with the flange 7.

Next, the operation will be described with reference to FIGS. 3 and 4.

Figure 3:
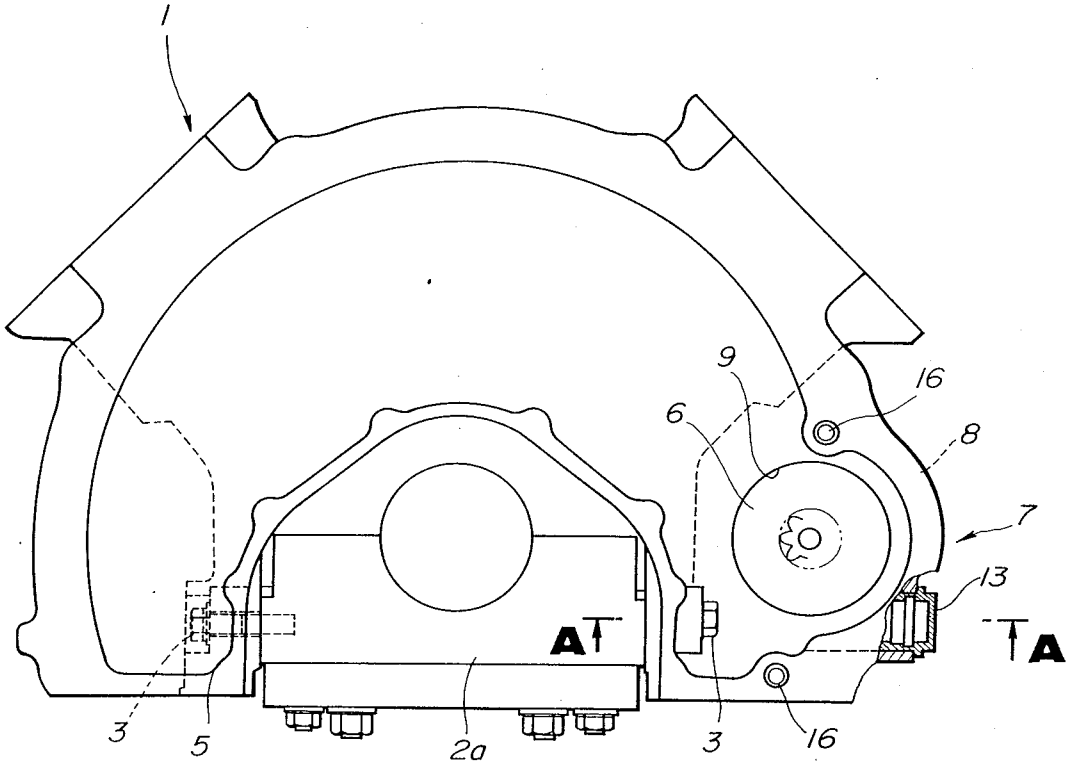
FIG. 3 is an enlarged rear view illustrating the cylinder block.

As shown in FIG. 3, the main bearing caps 2 are fixedly mounted to the cylinder block 1 by means of the side bolts 3. Inserted in the opening 9, the starter motor 6 is fixedly mounted to the flange 7 by means of bolts (not shown) inserted into holes 16. Referring to FIG. 4, the assembly operation will be described. First, to mount the main bearing cap 2a to the cylinder block 1, the side bolt 3 is inserted into the opening 12 formed in the side wall portion 11 of the flange 7, and it is threadedly engaged in its bolt hole 4 of a side boss 18 of the cylinder block 1 with a washer 19 interposed between the head of the side bolt 3 and the boss 18. After effecting an alignment, the main bearing cap 2a is fixedly secured to the cylinder block 1. Next, the starter motor 6 is inserted in the opening 9 formed in the mounting face 10, and then fixedly secured to the flange 7. The opening 12 is closed by the plug 13.

Referring to FIGS. 5 to 8, there is described a second preferred embodiment of the present invention.

Figure 6:
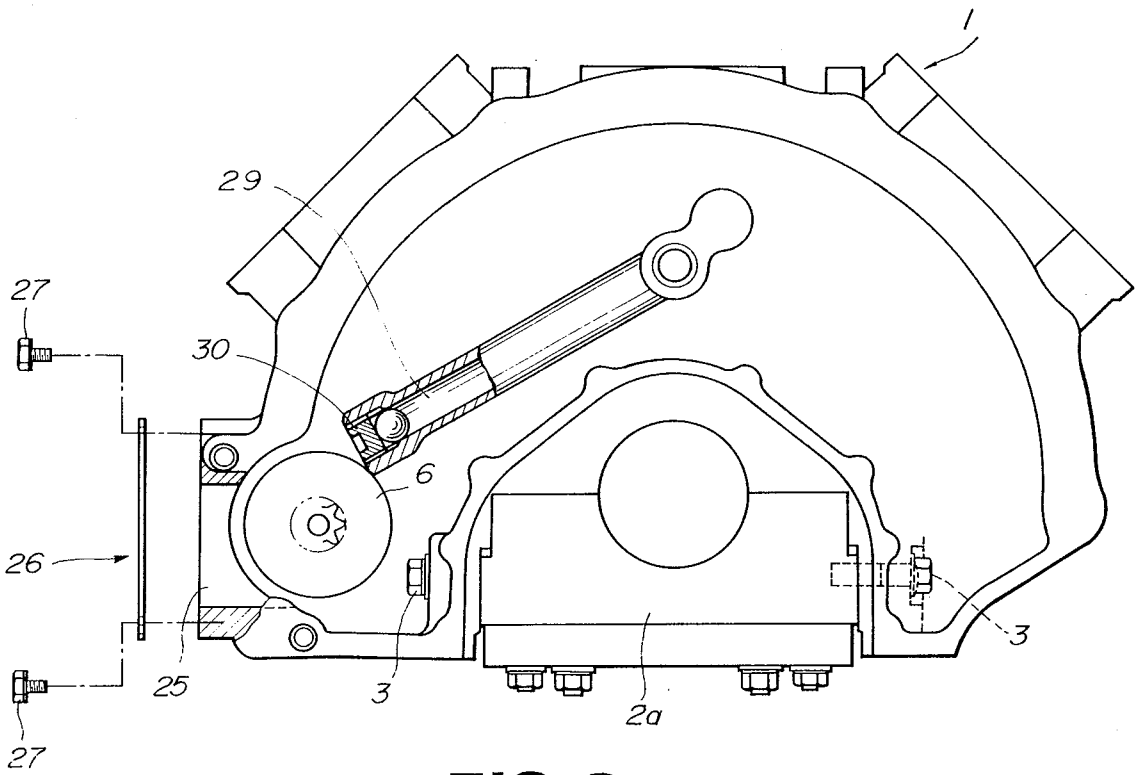
FIG. 6 is a view similar to FIG. 3, partly in section.
Figure 7:
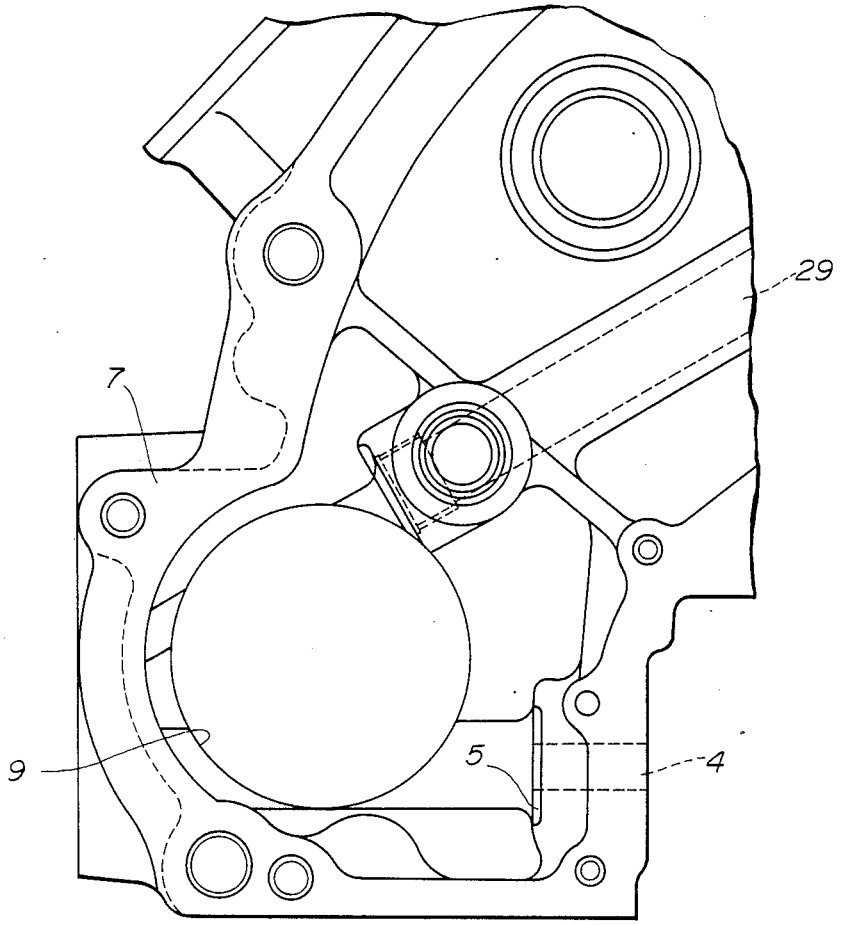
FIG. 7 an enlarged fragmentary view of FIG. 6 illustrating the vicinity of a starter motor mounting flange.
Figure 8:
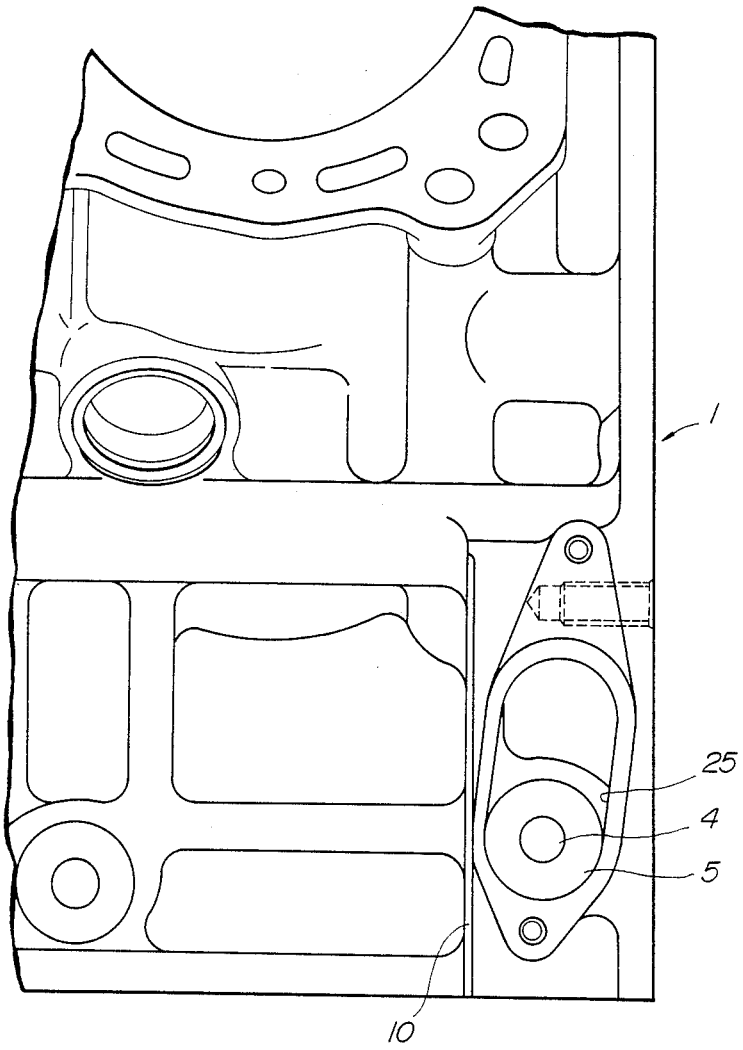
FIG. 8 is a side elevation of a portion of the cylinder block illustrating the vicinity of the starter motor mounting flange.

In a manner similar to the first preferred embodiment, a starter motor mounting flange 7 includes an opening 25 for mounting and removing a side bolt 3. In this embodiment, however, the opening 25 is used not only for passing therethrough the rearmost main bearing cap 2a to be mounted to a cylinder block 1 by means of a side bolt 3, but for allowing insertion of a tool for machining an inclined oil supply passage 29 to be formed through a cylinder bank 28 of a cylinder block 1. As best seen in FIG. 6, the oil supply passage 29 is machined by inserting the tool into the opening 25. After achieving the machining, the passage 29 is closed by means of a taper plug 30. Sequentially, as best seen in FIG. 7 and in a manner similar to the first preferred embodiment, the side bolt 3 is inserted into the opening 25 to secure the rearmost main bearing cap 2a to the cylinder block 1. Inserted into a starter motor opening 9, a starter motor 6 is fixedly mounted to a starter motor mounting surface 10 of the flange 7. Finally, as best seen in FIG. 6, a plug 26 is attached to a peripheral wall 11 of the flange 7 by means of bolts 27, closing the opening 25.

What is claimed is:

1. In an internal combustion engine:

a cylinder block having a predetermined end surface;

a plurality of main bearing caps including a predetermined main bearing cap, said plurality of main bearing caps being secured to said cylinder block at a plurality of portions including a predetermined portion, said predetermined main bearing cap being secured to said cylinder block at said predetermined portion;

a flange integral with said cylinder block, said flange having first and second end walls extending from said cylinder block and spaced from each other, and a peripheral wall which interconnects said first and second end walls, said first, second and peripheral walls cooperating with said predetermined portion of said cylinder block to define a chamber, said first end wall being disposed adjacent said predetermined end surface of said cylinder block, said second end wall being disposed less adjacent said predetermined end surface of said cylinder block, said peripheral wall being formed with an opening communicating with said chamber, said opening and said chamber serving as an access to said predetermined portion;

means for closing said opening;

a starter motor mounted on said flange.

2. An internal combustion engine as claimed in claim 1, wherein said second wall has an outer surface serving as an attachment surface, and said starter motor is secured to said attachment surface.

3. An internal combustion engine as claimed in claim 2, wherein said first end wall has an outer surface in the same plane as said predetermined end surface of said cylinder block.

4. An internal combustion engine as claimed in claim 3, wherein said opening and said chamber are sized to allow access of a bolt and a tool for tightening said bolt at said predetermined portion.

5. An internal combustion engine as claimed in claim 1, wherein said closing means is in the form of a plug of an elastic material, said plug including a cylindrical body with a cylindrical peripheral wall and a closed end wall, a lug on said closed end wall, a stopper flange extending radially outwardly from said cylindrical peripheral wall, a plurality of lips extending outwardly from said cylindrical peripheral wall, and means for biasing said plurality of lips radially outwardly.

6. An internal combustion engine as claimed in claim 5, wherein said biasing means is in the form of a snap ring disposed in said cylindrical body.

7. An internal combustion engine as claimed in claim 1, wherein said opening and said chamber are sized to allow access of not only a tool for tightening a bolt, but also a tool for drilling a bore in said cylinder block.

8. An internal combustion engine as claimed in claim 7, wherein said closing means is in the form of a plug attached to said peripheral wall of said flange.

9. In an automotive vehicle:

a cylinder block having a predetermined end surface;

a plurality of main bearing caps including a predetermined main bearing cap, said plurality of main bearing caps being secured to said cylinder block at a plurality of portions including a predetermined portion, said predetermined main bearing cap being secured to said cylinder block at said predetermined portion;

a flange integral with said cylinder block, said flange having first and second end walls extending from said cylinder block and spaced from each other, and a peripheral wall which interconnects said first and second end walls, said first, second and peripheral walls cooperating with said predetermined portion of said cylinder block to define a chamber, said first end wall being disposed adjacent said predetermined end surface of said cylinder block, said second end wall being disposed less adjacent said predetermined end surface of said cylinder block, said peripheral wall being formed with an opening communicating with said chamber, said opening and said chamber serving as an access to said predetermined portion, said first end wall having an outer surface in the same plane as said predetermined end surface;

means for closing said opening;

a starter motor mounted on said flange;

a rear plate;

a transmission casing securely connected to said predetermined end surface and said outer surface of said first end wall of said flange.

* * * * *